US011286928B2

(12) United States Patent
Krampe et al.

(10) Patent No.: US 11,286,928 B2
(45) Date of Patent: Mar. 29, 2022

(54) CONTROLLING THE GAP GEOMETRY IN AN ECCENTRIC SCREW PUMP

(71) Applicant: VOGELSANG GMBH & CO. KG, Essen (DE)

(72) Inventors: Paul Krampe, Essen (DE); Michael Rolfes, Essen (DE)

(73) Assignee: VOGELSANG GMBH & CO. KG, Essen (DE)

( * ) Notice: Subject to any disclaimer, the term of this patent is extended or adjusted under 35 U.S.C. 154(b) by 210 days.

(21) Appl. No.: 16/478,023

(22) PCT Filed: Jan. 16, 2018

(86) PCT No.: PCT/EP2018/050986
§ 371 (c)(1),
(2) Date: Jul. 15, 2019

(87) PCT Pub. No.: WO2018/130718
PCT Pub. Date: Jul. 19, 2018

(65) Prior Publication Data

US 2020/0124046 A1 Apr. 23, 2020

(30) Foreign Application Priority Data

Jan. 16, 2017 (DE) ..... 10 2017 100 715.6

(51) Int. Cl.
*F01C 1/10* (2006.01)
*F03C 2/00* (2006.01)
(Continued)

(52) U.S. Cl.
CPC ..... *F04C 2/1073* (2013.01); *F04C 3/06* (2013.01); *F04C 14/06* (2013.01); *F04C 15/003* (2013.01); *F04C 2250/201* (2013.01)

(58) Field of Classification Search
CPC ..... F04C 2/1071; F04C 2/1073; F04C 3/06; F04C 5/00; F04C 14/06; F04C 15/003;
(Continued)

(56) References Cited

U.S. PATENT DOCUMENTS 2,085,115 A * 6/1937 Moineau ..... F04C 2/1071 418/48
2,527,673 A 10/1950 Byram
(Continued)

FOREIGN PATENT DOCUMENTS

AT 223042 8/1962
AU 2015202547 11/2015
(Continued)

*Primary Examiner* — Theresa Trieu
(74) *Attorney, Agent, or Firm* — Price Heneveld LLP

(57) ABSTRACT

A progressive cavity pump for transporting a liquid containing solids comprises a helical rotor, a stator having an inlet and an outlet, within which the helical rotor is rotatably disposed about a longitudinal axis of the stator, and comprising a helical inner wall corresponding to the helical rotor. The helical rotor comprises a shape tapering down toward the outlet or inlet, and the helical rotor and stator are disposed relative to each other and implemented such that at least one chamber is formed for transporting the liquid, and the chamber is cut off by a constriction. The progressive cavity pump includes an adjusting device for adjusting a relative axial position of the helical rotor and stator, wherein the adjusting device is implemented for expanding the constriction between the helical rotor and stator.

26 Claims, 8 Drawing Sheets

(51) Int. Cl.

| | |
|---|---|
| ***F03C 4/00*** | (2006.01) |
| ***F04C 2/00*** | (2006.01) |
| ***F04C 2/107*** | (2006.01) |
| ***F04C 3/06*** | (2006.01) |
| ***F04C 14/06*** | (2006.01) |
| ***F04C 15/00*** | (2006.01) |

(58) Field of Classification Search
CPC ..... F04C 15/0076; F04C 2230/601; F04C 2230/602; F04C 2250/201; F05C 2225/00; F05C 2225/02; F05C 2225/04
See application file for complete search history.

(56) References Cited

U.S. PATENT DOCUMENTS

| | | | | |
|---|---|---|---|---|
| 3,139,035 | A | 6/1964 | O'Connor | |
| 6,358,027 | B1 * | 3/2002 | Lane | F04C 2/1071 418/1 |
| 6,457,958 | B1 * | 10/2002 | Dunn | F04C 2/1071 418/48 |
| 2009/0214369 | A1 * | 8/2009 | Brun | F04C 2/1071 418/48 |
| 2015/0322946 | A1 * | 11/2015 | Krampe | F16D 3/387 418/182 |
| 2015/0354280 | A1 | 12/2015 | Downton et al. | |
| 2016/0208798 | A1 | 7/2016 | Sawyer et al. | |
| 2017/0074100 | A1 * | 3/2017 | Jarvis | F04C 2/1071 |

FOREIGN PATENT DOCUMENTS

| | | | |
|---|---|---|---|
| CN | 104047846 | 9/2014 | |
| DE | 2527141 | 1/1976 | |
| DE | 2632716 | 1/1978 | |
| DE | 102014117483 | 10/2015 | |
| DE | 102015112248 | 8/2016 | |
| EP | 1739307 | 1/2007 | |
| EP | 1988288 | 11/2008 | |
| FR | 1284388 A * | 2/1962 | F04C 2/1073 |
| GB | 916155 | 1/1963 | |
| JP | 2009-047153 | 3/2009 | |
| JP | 2010-001876 | 1/2010 | |
| WO | 2010100134 | 9/2010 | |

* cited by examiner

CONTROLLING THE GAP GEOMETRY IN AN ECCENTRIC SCREW PUMP

CROSS-REFERENCE TO FOREIGN PRIORITY APPLICATION

The present application claims the benefit under 35 U.S.C. §§ 119(b), 119(e), 120, and/or 365(c) of PCT/EP2018/050986 filed Jan. 16, 2018, which claims priority to German Application No. 102017100715.6 filed Jan. 16, 2017.

FIELD OF THE INVENTION

The invention relates to a progressive cavity pump for transporting fluids loaded with solids, having a helical rotor, a stator having an inlet and an outlet, in which the rotor is rotatably disposed about a longitudinal axis of the stator, and comprising a helical inner wall corresponding to the rotor. The rotor comprises a shape tapering down toward the outlet or inlet, preferably conical, and/or a variable eccentricity, and the rotor and stator are disposed relative to each other and implemented such that at least one chamber is formed for transporting the liquid, and the chamber is cut off by a constriction, particularly a sealing line. The invention further relates to a method for operating such a progressive cavity pump.

BACKGROUND OF THE INVENTION

Progressive cavity pumps of the type indicated above have been known for several years and are used particularly for gently transporting and metering liquids loaded with solids, abrasive liquids, or general liquids. Said pumps use a single or multi-start helical rotor disposed in a corresponding double or multi-start chamber of a stator and rotates therein. The screw in a progressive cavity pump rotates about a screw rotation axis, in turn rotating about a longitudinal stator axis typically parallel thereto, resulting in a rotary motion of the screw, guided eccentrically on a circular path, and from which the term "eccentric" is derived for the progressive cavity pump. The screw of a progressive cavity pump is thereby often driven by an eccentric shaft formed by a shaft having Cardan joints at each end between the drive motor and the rotor. By designing the outer profile of the rotor and the inner profile of the stator accordingly, a constriction results, particularly a sealing line sealing off from each other the at least one chamber, but preferably individual chambers of a plurality of chambers. The rotor and the stator can make direct contact with each other and form a sealing line, or can have a sealing gap separating the chambers in the constriction. The rotor is thereby typically implemented as a single helix and the stator as a double helix having twice the pitch, resulting in the sealing off of the individual chambers.

A screw pump is known from DE2632716, comprising a conical screw and a conical pressure shell. In said embodiment, the screw has a conicity of about 30° cone angle, whereby an increase in the transport pressure is intended to be achieved for a short screw length. The screw and pressure shell are thereby axially adjustable relative to each other, in that the pressure shell is axially displaceably guided in a sleeve. A pressure is thereby intended to be held constant, in that the pressure shell is shifted under the influence of the liquid pressure on a ring component of the pressure shell in the pump. Systematically, however, an increase in pressure at the outlet can only bring about a vertical displacement and thus pressing of the pressure shell against the screw. A further disadvantage of said known system is that the object of the system is designed solely for constancy of the increased pressure generated by the reduction in cross-sectional area in the transport direction of the conical pump gap and does not allow any axial shifting depending on other influencing parameters.

A screw pump is also known from AT223042, comprising a conical stator and rotor. By means of a threaded sleeve inserted between the rotor and the output shaft, the rotor of said screw pump can be adjusted axially with respect to the stator, in that a user manually rotates the sleeve by means of a tool through a hand hole while the pump is stopped. Both seizing and excess clearance between the stator and the rotor, caused by swelling of the stator or wear of the rotor and/or stator, can be thereby compensated for.

A progressive cavity pump is known from DE102015112248A1, wherein the gap geometry between the rotor and stator can be varied by adjusting the pretension of the stator. Increasing the pretension brings about compressing of the stator implemented as an elastomer component and can thereby reduce the gap geometry. A disadvantage of said progressive cavity pump, however, is that the elastomer thicknesses of the stator vary in both the circumferential direction and the longitudinal direction due to the geometry thereof, and therefore increased pretension leads to non-uniform elastic deformation. Reliable operation of the progressive cavity pump is therefore not ensured and locally increased wear can be caused by the non-uniform gap geometry associated with said adjusting.

Conical progressive cavity pumps are also known for progressive cavity pumps, as such allow both simple assembly and adjusting of the rotor relative to the stator in case of wear. One such progressive cavity pump is known from WO 2010/100134 A2, for example. Said document proposes a progressive cavity pump having a conical rotor for preventing or compensating for wear, implemented such that the individual chambers all have identical volumes. If signs of wear then occur during operation, particularly what is known as cavitation, it is possible to shift the rotor axially with respect to the stator so that the chamber volumes are again identical in size and sealing is achieved.

A disadvantage of said known solutions is that said solutions can only compensate for existing wear of the stator by shifting the rotor. The screw pumps and progressive cavity pumps known from the prior art cannot prevent the occurrence of wear as such.

It is therefore the object of the present invention to disclose a progressive cavity pump of the type indicated above, not only for compensating for existing wear, but also for reducing the occurrence of wear, thus increasing the service life of the progressive cavity pump and reducing maintenance effort.

SUMMARY OF THE INVENTION

The object is achieved by a progressive cavity pump of the type indicated above, in that said pump has an adjusting device for adjusting a relative axial position of the rotor and stator implemented for optimizing the gap geometry between the rotor and stator, in that said device is set up for expanding the constriction between the rotor and stator.

The invention is based on the insight that the gap geometry, that is, the geometry of the constriction separating the chamber(s) is important for sufficiently implementing sealing, so that pumping is possible, and that friction occurs during operation of the progressive cavity pump, whereby the individual components, particularly the rotor and stator, heat up and then a pretension between the rotor and stator is increased due to material expansion, or the constriction becomes too small. The increased pretension then leads to further wear.

The invention recognizes that all wear can be prevented, or reduced, if the constriction is expanded during operation and thereby the gap geometry can be adapted to the operating conditions and thus optimized. The present invention therefore proposes an adjusting device implemented for expanding the constriction between the rotor and stator. If the constriction is further expanded, then contact at lower pretension or no contact is present, and thereby less friction between the rotor and stator, in turn leading to lower wear. When pumping liquid, an additional cooling effect occurs, so that the parts can again cool down when the pretension is reduced. It is thereby also possible, for example, to adjust a larger gap when starting up the progressive cavity pump in order to keep friction low in the dry state. It is also possible to operate the progressive cavity pump in an energy-saving manner by adjusting to the optimal overall efficiency, taking into consideration the volumetric efficiency and friction losses. Merely slightly expanding the constriction, however, is advantageous for media sensitive to shear. The progressive cavity pump can thus be adjusted by means of the invention to the media being transported.

The rotor comprises a shape tapering down toward the outlet or inlet. The shape is determined by the envelope enclosing the rotor. The shape is preferably conical. The rotor thus has a diameter becoming smaller in the direction of the outlet or the inlet. The rotor preferably tapers linearly. It is also preferable, however, that the rotor comprises a tapering shape according to a prescribed function, such as a 2nd, 3rd, or 4th degree function. The diameter is then reduced progressively or degressively. Depending on the loading of the rotor, this has advantages for preventing excessive wear. The selection of whether the rotor tapers toward the inlet or outlet particularly depends on structural boundary conditions and should be made dependent on the type of assembly. The direction of the taper determines the direction in which the rotor is inserted into the stator.

Alternatively or additionally, the rotor comprises an eccentricity varying in the direction of the inlet or the outlet. The eccentricity preferably varies linearly, that is, increases or decreases linearly. It is also preferable, however, that the rotor comprises an eccentricity according to a prescribed function, such as a 2nd, 3rd, or 4th degree function. The eccentricity is then reduced progressively or degressively.

In both cases, the stator is adapted to the rotor and consequently comprises a corresponding inner contour.

It is fundamentally preferable that the tapering and/or change in eccentricity of the rotor in the transport direction is so slight that no significant reduction in the gap cross section in the transport direction is thereby brought about, in order to prevent an undesired increase in pressure. This can be achieved, for example, in that the tapering is selected so that the two lines centering the envelope end in a longitudinal section on both sides form a cone angle to each other of less than 20°, preferably less than 10°, and particularly less than 5°. It is particularly preferable that the difference in area between the gap cross-sectional area at the outlet of the stator and the gap cross-sectional area at the inlet of the stator caused by the tapering is less than 10%, preferably less than 5% of the gap cross-sectional area at the inlet of the stator.

For a varying eccentricity at constant diameter, it is also possible to expand a constriction by means of axially shifting. A segment of the rotor having a smaller eccentricity can thus be brought into a segment of the stator having greater eccentricity, whereby the constriction is expanded. A combination of a tapering rotor and a rotor having varying eccentricity is also preferable.

In a preferred embodiment, the adjusting device is set up for expanding the constriction between the rotor and stator to the extent that a leakage gap is implemented between the rotor and stator. In this case, the constriction is formed not by contact between the rotor and stator, but rather by a slight gap, the leakage gap, nevertheless providing a certain sealing. In this case, the transport rate is indeed reduced, but due to the lack of physical contact between the rotor and stator, and the liquid film between said components, additional cooling occurs and wear is further reduced. It can be provided that such a leakage gap is not continuously present during operation, but rather is set only during or after exceptional loading.

It is further preferable that the adjusting device is set up for performing the expanding of the constriction depending on one or more predetermined operating parameters. It is conceivable, for example, that expanding of the constriction is adjusted automatically after a certain operating duration. It is also conceivable that the power consumption of a drive motor is measured and the constriction is expanded when the power consumption increases. The expanding of the constriction preferably occurs depending on a plurality of operating parameters. It is indeed also conceivable and preferable to use only one single operating parameter, but by using a plurality of operating parameters, wear can be more effectively reduced.

One of the operating parameters, the temperatures of the stator and/or the rotor, is particularly preferred. The temperature of the stator is preferably measured. To this end, the progressive cavity pump preferably comprises at least one sensor disposed in or on the stator and measuring the temperature of the stator. The temperature is preferably measured at a plurality of locations in order to be able to particularly effectively reduce wear. A continuous expanding of the constriction preferably takes place depending on the temperature. Alternatively, one or more threshold values are predetermined, and if one or more threshold value is exceeded then a stepwise expanding of the constriction is performed.

One of the operating parameters, preferably a further one, is the transported volume of liquid. The transported volume of liquid is preferably the volume of liquid per revolution. If the transported volume of liquid per revolution decreases, this means that more gas or air is being transported. When gas or air is transported, the cooling effect that the medium has on the progressive cavity pump is less than when transporting a liquid. It is therefore preferable in this case to expand the constriction in order to prevent wear. To this end, it is also conceivable that a flow meter is disposed at the inlet or the outlet of the stator.

According to a further preferred embodiment, one of the operating parameters is a liquid level at the inlet of the stator. A liquid sensor or a plurality of liquid sensors are preferably provided here. It can be preferable to measure only a particular fill level as a threshold value. Alternatively, continuously measuring the fill level at the stator inlet is also preferable. If there is a low liquid level at the stator inlet, the probability that the progressive cavity pump will run dry is greater, whereby the friction is also greater and the cooling of the progressive cavity pump is less. This in turn leads to rapid heating and thus to material expansion whereby the constriction is further contracted and pretension can increase. It is therefore preferable that, in the case that a low liquid level is measured at the inlet of the stator, the constriction between the rotor and stator is expanded.

A further conceivable parameter is the pressure at the outlet. If said parameter remains equal or decreases and the torque increases simultaneously, this is an indicator of increased friction between the rotor and stator and thus an indicator of swelling of the stator material. In such a case it is also preferable to expand the constriction in order to adapt the gap geometry to the modified boundary conditions.

In a further preferred embodiment, the stator is axially displaceably supported and the adjusting device is set up for axially displacing the stator in order to at least partially expand the constriction between the rotor and stator. The rotor is typically coupled to a drive and the stator is fixedly supported in the direction of rotation. In case of wear, the stator must be replaced first, as the stator is typically made of a softer material than the rotor. Because the stator must be disposed easily replaceably for this reason, it is proposed in the present embodiment to support the stator so as to be axially displaceable in order to thus at least partially expand the constriction between the rotor and stator. To this end, the adjusting device is preferably coupled to the stator in order to shift the stator. To this end, the adjusting device can be coupled to a drive of the stator provided for this reason. Such a drive of the stator is implemented in a preferred embodiment as a hydraulic drive, rack and pinion drive, chain drive, spindle drive, or the like. The drive of the stator is preferably implemented so that an axial position of the stator can be retained. This is preferably implemented in that the drive of the stator is self-blocking in design.

In a further preferred embodiment, the rotor is axially displaceably supported and the adjusting device is set up for axially displacing the rotor in order to at least partially expand the constriction between the rotor and stator. It should be understood that a combination of the two displacements is possible and preferable, that is, that both the rotor and the stator are axially displaced. It is thereby possible to keep the absolute distances of the displacement small.

In a variant, a drivetrain of the rotor, comprising a drive motor and a drive shaft, is displaceable together with the rotor. The rotor is typically coupled by means of a shaft to a drive motor, typically implemented as an electric motor. Because the rotor rotates eccentrically about a center axis of the stator, that is, the center axis thereof describes a circular path about the center axis of the stator, such a drive shaft typically also comprises at least one Cardan joint or flexible rod in order to permit eccentric torque transfer. In the present embodiment, both the drive motor and the drive shaft, as part of the drivetrain, are supported for displacing together with the rotor. The design of the drivetrain is thereby simplified and a linear bearing is provided for the drive motor, for example, having a drive provided for this reason, as described above with respect to the stator.

In a further variant, also implementable in addition to the variant described above, the rotor and drive shaft together are displaceable relative to the drive motor. In the present variant, it is preferable that a gearbox is disposed between the drive shaft and the drive motor, allowing an axial displacement of the drive shaft. For example, gears of the gearbox are implemented so that axial displacement is enabled. In the present variant, the arrangement of the drive motor is simplified, while the design of the gearbox is more difficult than for the previously described embodiment. A further advantage thereby is that the mass of the displaceable components is lower. It is further possible to support the drive motor separately.

In one variant, or in addition thereto, the drive shaft has at least two parts and comprises an expansion member allowing lengthening and shortening the drive shaft for axially displacing the rotor. The drive shaft in the present embodiment example can be telescoping in design and can automatically perform the lengthening, or a separate drive for displacing the rotor is provided for the rotor. It is conceivable, for example, that a hydraulically driven expansion member is disposed in the drive shaft and allows axial adjustment by applying hydraulic pressure. Alternatively to a hydraulic expansion member, a mechanically acting expansion member can also be provided, for example in the sense of a spindle drive.

Alternatively or in addition, a separate drive unit is provided for the rotor and displaces the rotor axially while the expansion member is passive and allows displacing. The design is thereby further simplified.

According to a further preferred embodiment, the longitudinal axis of the stator is oriented substantially vertical or upright during operation and the outlet of the stator is disposed at the top. Further advantages arise from this. One is that the constriction or pretension between the rotor and stator is not constricted or increased in the lower stator region by the additional weight of the rotor. A further advantage arises in that when the gap geometry is changed to the extent of a leakage gap, liquid flows downward, in the direction of the inlet, and thus an additional cooling effect is achieved. It is particularly advantageous in the present variant that if not only liquid, but also gas is being transported, the liquid is constantly present in the region of the contact points, that is, in the region of the sealing line, and thus cooling of the sealing line is ensured even when transporting a large proportion of gas. Heating up and thus increasing the friction and pretension, or excessive contracting of the constriction, is thereby prevented. This further prevents wear. The vertical arrangement further saves space and the progressive cavity pump can be particularly easily installed in existing systems. The vertical arrangement is made possible in that the constriction can be expanded.

In a further preferred embodiment, the stator is formed of a pliable material, particularly an elastomer, at least in the region of the inner wall. The manufacture of the stator is thereby simplified, and good sealing is produced between the stator and the rotor. In a variant, it can be provided that the inner wall of the stator is coated with a substantially uniformly thick layer of elastomer material. In another variant, the entire stator is formed of elastomer material and provide with an external cuff for stabilizing.

According to a further preferred embodiment, it is provided that the adjusting device is implemented for expanding the constriction between the rotor and stator prior to beginning a startup procedure, or during or after a shutdown procedure of a drive motor for rotating the rotor, and in order to contract the constriction between the rotor and stator prior to beginning during the startup procedure of the drive motor. According to the present embodiment, the constriction between the rotor and stator is adjusted from an expanded constriction to an elongated constriction during the beginning of a transport procedure of the progressive cavity pump, that is, during or after the startup of a drive motor generating the rotational motion of the rotor relative to the stator. The progressive cavity pump is thereby adjusted from an initially high inner leakage current to a reduced leakage current. Said adjusting motion leads to the transport volume and/or transport pressure of the progressive cavity pump not abruptly building up, which would cause a high load on the progressive cavity pump and the connected lines, but rather building up continuously over a starting period. Said starting period can be in the range from one second to a plurality of seconds. The present embodiment is particularly advantageous if a drive motor is used having no variable frequency drive for controlling speed, but rather immediately increasing to the nominal speed when starting up.

It should be fundamentally understood that for the purpose of said controlling, the constriction between the rotor and stator can be expanded at each end of a transport procedure, so that said constriction is in an expanded state for a subsequent beginning of a transport procedure, or that prior to startup of the drive motor when starting a transport procedure, a corresponding expanding of the constriction is performed in order to then start said drive motor after performing said expanding. In both manners, it can be ensured that when the drive motor is started, no contracted constriction or even direct contact is present between the stator and rotor, causing a high transport volume and high transport pressure immediately, right from the start.

It is still further preferable if the adjusting device comprises an input interface for receiving a pressure signal and is implemented for expanding or contracting the constriction between the rotor and stator depending on the pressure signal. According to the present refinement, the adjusting device, potentially fundamentally comprising a corresponding controller, potentially implemented as an electronic controller, is implemented for performing a change in the constriction between the rotor and stator depending on a pressure signal. The pressure signal can thereby be a pressure at the inlet side, a pressure within the stator, or a pressure at the outlet side of the stator, that is, particularly also a pressure-side pressure of the progressive cavity pump. In this manner, the pressure can be adjusted precisely, and further a prescribed pressure curve can be set as the actual pressure curve by adjusting the constriction accordingly. Said setting or controlling is performed according to the invention by expanding or contracting the extension between the rotor and stator, allowing substantially more precise, more spontaneous, and more responsive adjusting or controlling in comparison with potentially controlling the speed of the rotor and stator. The present embodiment can particularly also be used for providing overpressure protection. In this case, when a particular pressure is reached or the particular pressure is exceeded, the constriction between the rotor and stator is expanded and thereby an increase in pressure above a particular maximum pressure is prevented.

The progressive cavity pump according to the invention can be further refined in that the adjusting device comprises an input interface for receiving a volume signal and is implemented for expanding the constriction between the rotor and stator depending on the volume signal, such that for a value of the volume signal signaling that a volume transported since the beginning of the transport procedure corresponds to a specified volume the constriction between the rotor and stator is expanded such that no further transporting of a volume out of the outlet of the stator occurs. According to the present embodiment, the adjusting device is implemented for receiving a volume signal. Said volume signal can fundamentally characterize a specified volume to be transported by the progressive cavity pump. This means that from the start to the end of an integral transport procedure, that is, a constant operation of the progressive cavity pump, a particular volume is to be transported by the progressive cavity pump. The inventors have fundamentally recognized that such precise metering of a particular transport volume cannot be sufficiently reached by controlling and regulating the drive motor driving the rotor, due to inertia and run-on effects. Instead, according to the invention, the constriction between the rotor and stator is adjusted such that the precise metering can thereby be adjusted and controlled. This means particularly that when the desired volume is reached, that is, the specified volume value, the constriction is expanded such that no further volume is transported by the progressive cavity pump. The adjusting or controlling of the constriction between the rotor and stator can particularly be done in such a manner that when only a small portion of the desired specified volume remains to be transported, an expanding of the constriction between the rotor and stator is set and in this manner the transported volume is reduced in one or two stages or continuously. The actual volume can thereby be captured by a corresponding volume meter, or can be calculated from the number of revolutions of the progressive cavity pump and the dimension of the constriction between the rotor and stator over the transport time period. A specified value signal can be captured by the adjusting device as the volume signal or can be input to the adjusting device; in this case, the calculating of the actuating variable for the constriction between the rotor and stator takes place within the adjusting device and can be implemented by internal calculating or additionally inputting actual values into the adjusting device. The volume signal can also be a difference signal derived from the specified value and the actual value in order to enable directly calculating the actuating variable within the adjusting device. It is further preferable that the adjusting device is implemented for adjusting the relative axial position of the rotor to the stator while the rotor is rotating relative to the stator. The present embodiment for axially adjusting while the pump is running can be implemented, for example, by an adjusting device accessible or actuatable from the outside. The adjusting device can be implemented as an energy-powered actuator and thus enable adjusting during rotation, for example in that a hydraulic, pneumatic, or electrically driven actuator is provided at the pump for axially adjusting between the rotor and stator.

According to a second consideration of the invention, the object indicated above is achieved by a method for operating a progressive cavity pump according to at least one of the preferred embodiments described above of a progressive cavity pump according to the first consideration of the invention, having the steps: driving the rotor for transporting a liquid; expanding the constriction between the rotor and stator by axially displacing the rotor and stator relative to each other. It should be understood that the progressive cavity pump according to a first consideration of the invention and the method according to the second consideration of the invention have identical and similar preferred embodiments, as are particularly set forth in the dependent claims. In this respect, reference is made in full to the above description of the first consideration of the invention.

The method preferably further comprises the step: adjusting a leakage gap between the rotor and stator. The adjusting of the leakage gap is preferably performed during the driving of the rotor for transporting a liquid. That is, the displacing of the rotor and stator relative to each other, as well as the adjusting of a leakage gap, preferably take place during operation, preferably namely when an operating parameter reaches or exceeds a threshold value.

The method preferably further comprises the step: measuring a temperature of the rotor and/or the stator; and axially relatively displacing the rotor and stator based on the measured temperature. If a predetermined threshold temperature is exceeded, for example, then the rotor and stator are displaced axially relative to each other such that the constriction is expanded depending on said exceeding. It can also be provided that when the temperature falls, contracting of the constriction is performed, up to contact under pretension, in order to thus keep leakage low. The temperature of the rotor and/or the stator is preferably continuously measured, preferably at predetermined small time intervals. Depending on said measurements, a shifting between the rotor and stator is then performed dynamically, so that the constriction present between the rotor and stator and thus the gap geometry is constantly in harmony with the measured temperature, so that wear can be prevented.

The following steps are further preferably performed: determining a liquid level at the inlet of the stator; and axially relatively displacing the rotor and stator depending on the liquid level determined. The liquid level is preferably determined by means of a liquid sensor. It can be provided that the liquid level is determined only relative to a particular threshold, such as half of the maximum inlet flow rate. Based on the liquid level determined, a relative axial displacement of the rotor and stator is performed, preferably by a predetermined fixed value. The constriction is thereby expanded and wear is thus prevented. It can also be provided that when the liquid level rises again, the constriction is again contracted, that is, a smaller gap or contact is set, in order to thus achieve an optimal gap geometry and transport.

In a further preferred embodiment, the method further comprises: determining a transported volume of liquid per revolution of the rotor; and relatively axially displacing the rotor and stator depending on the liquid volume determined. A low volume of transported liquid per revolution of the rotor indicates that a relatively high proportion of gas is being transported. Transporting gas prevents lubricating between the parts in contact with each other, and prevents cooling. In this case, when a relatively large amount of gas is transported and little liquid per revolution of the rotor, it is preferable that the constriction is expanded in order to thus prevent wear.

The method can be further refined in that the constriction between the rotor and stator is expanded at the beginning of a startup of a drive motor for rotating the rotor, and the constriction between the rotor and stator is contracted after beginning a startup of the drive motor. By means of the present refinement of the method, a gentle startup behavior is achieved without any abrupt increase in transport volume and transport pressure. With respect to the advantages, variants, and considerations of the present refinement, reference is made to the above description of the corresponding embodiment of the progressive cavity pump.

It is further preferable if a pressure is captured by means of a pressure sensor, and the constriction between the rotor and stator is expanded or contracted depending on the pressure. By means of the present embodiment of the method, precise controlling of a pressure, a pressure curve, or compliance with a minimum and/or maximum pressure is achieved in that the constriction between the rotor and stator is adjusted accordingly. This enables spontaneous and precise pressure control. To this end, reference is made to the corresponding design of the progressive cavity pump and the above description thereof.

It is further preferable if a specified volume is captured, and the constriction between the rotor and stator is expanded or contracted depending on the specified volume. According to the present embodiment, the progressive cavity pump is controlled and regulated as a precise metering pump. To this end, a specified volume is entered or received by the progressive cavity pump, and the constriction between the rotor and stator is expanded or contracted depending on said specified volume. Said expanding or contracting of the constriction between the rotor and stator is thereby adjusted such that when the specified volume is reached, the transport volume is reduced to zero. This can be done by correspondingly expanding of the constriction, or can be done in conjunction with such expanding and terminating the rotation of the rotor. Stepwise or continuous expanding or contracting can particularly bring about precise metering to the desired specified volume, if such expanding is performed when only a small proportion of the specified volume needs to be transported in order to achieve the specified volume. For the present embodiment, reference is again made to the above explanation of the corresponding embodiment of the progressive cavity pump.

BRIEF DESCRIPTION OF THE DRAWINGS

The invention is described in more detail below, using five embodiment examples and referencing the attached figures. Shown are.

DETAILED DESCRIPTION OF THE EMBODIMENTS

Figure 1:
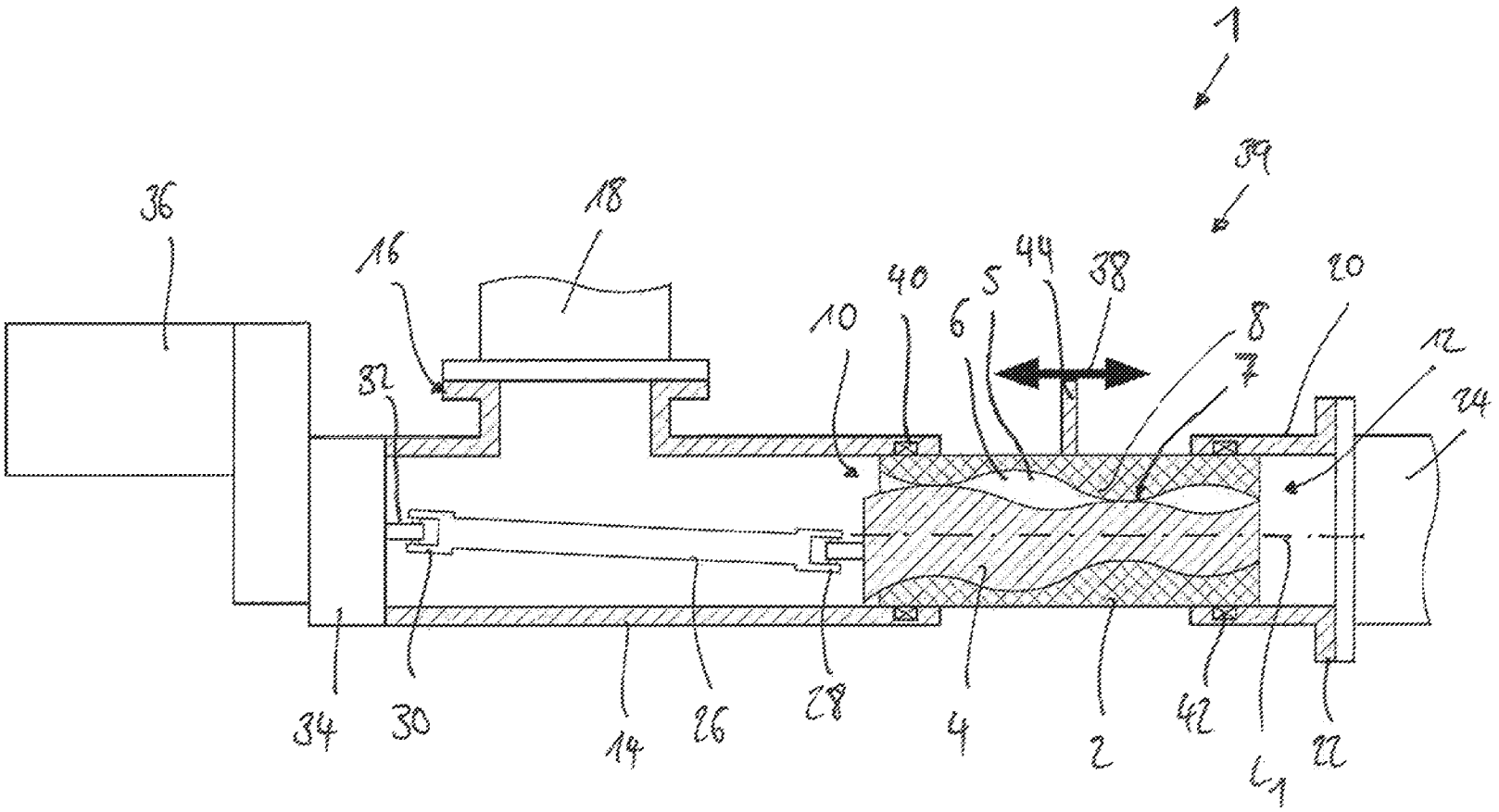
FIG. 1 is a schematic cross section through a progressive cavity pump according to a first embodiment example.

A progressive cavity pump 1 comprises a stator 2 and a rotor 4. The stator has a center axis L1 extending centrally through an inner cavity 6 of the stator 2. The stator 2 comprises an inner wall 8 bounding the cavity 6 and formed of an elastomer material. An inner contour 9 of the inner wall 8 is formed so as to define a double helix. The rotor 4 is also helical in overall design, wherein the pitch of the helix of the stator 2 has double the pitch with respect to the rotor 4. Individual chambers 5 separated by a constriction 7 are thus formed.

The stator 2 further comprises an inlet 10 and an outlet 12. The inlet 10 is connected to an inlet housing 14 comprising an inlet flange 16 to which an inlet pipe 18 is connected. The outlet 12 further has an outlet housing 20 comprising an outlet flange 22 to which an outlet pipe 24 is connected.

A drive shaft 26 extends through the inlet housing 14 and is connected to the rotor 4 by means of a first Cardan joint, and connected to an output shaft 32 of a gearbox 34 by means of a second Cardan joint 30. In place of such a drive shaft 26 having two Cardan joints 28, 30, a thin flexible shaft is also preferable and allows eccentric driving. The input side of the gearbox 34 is connected to a drive motor 36 implemented as an electric motor according to the present embodiment example.

The progressive cavity pump 1 according to the invention comprises an adjusting device 39 for expanding the constriction 7 between the rotor 4 and stator 2 in order to set an optimal gap geometry. According to the present embodiment example (FIG. 1), the adjusting device 39 is implemented such that the stator 2 is axially displaceably supported. The stator 2 is displaceable along the longitudinal axis L1 as indicated by the arrow 38. To this end, the stator 2 is received in segments of the inlet housing 14 and the outlet housing 20 and sealed off by means of seal 40, 42. The adjusting device 39 comprises an engaging segment 44 for displacing the stator 2 and potentially connected to a drive provided for this purpose.

Figures 2A, 2B, 2C:
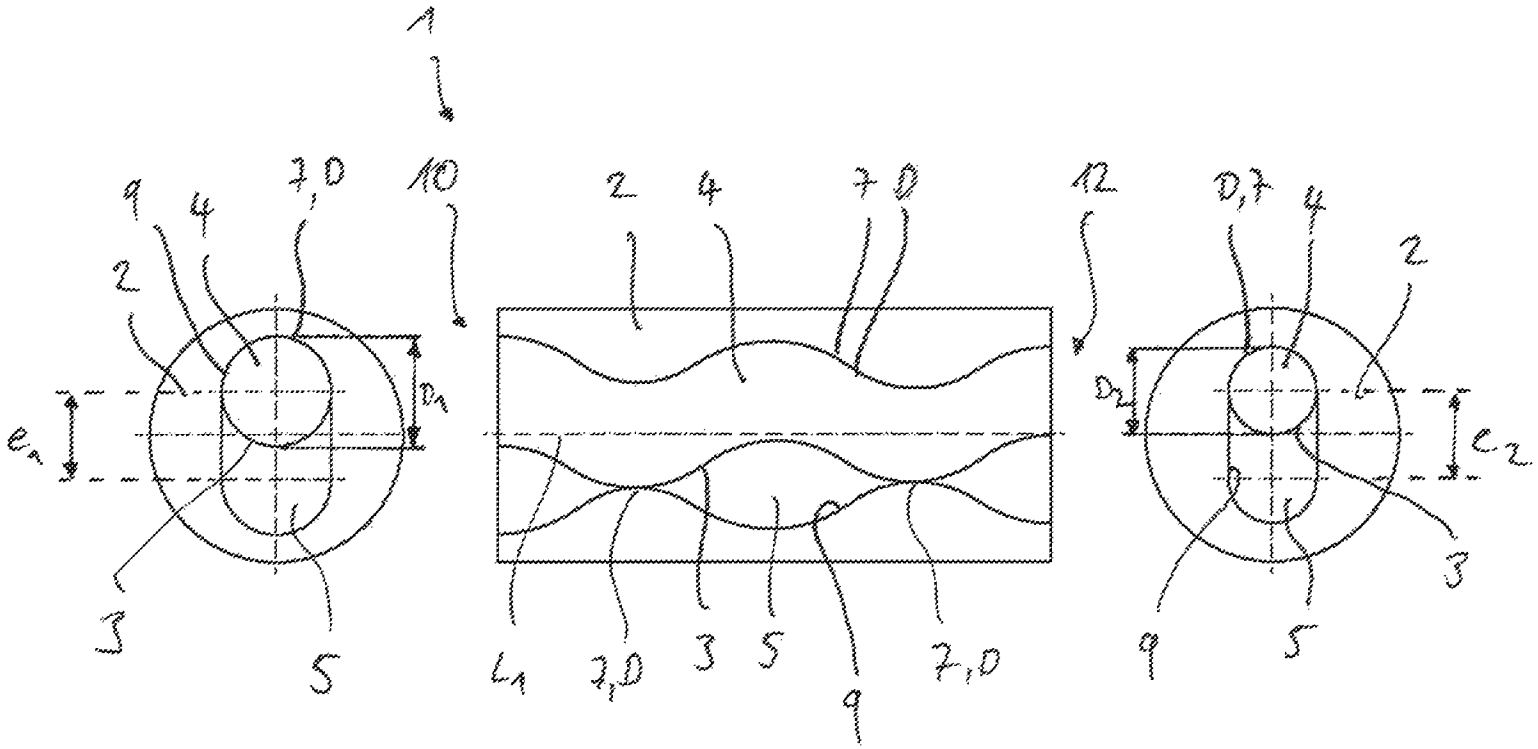
FIG. 2*a* is a schematic cross section of the inlet of and through a progressive cavity pump perpendicular to the longitudinal axis with a sealing line set.
FIG. 2*b* is a schematic cross section along the longitudinal axis of the progressive cavity pump according to FIG. 2*a;*
FIG. 2*c* is a schematic cross section of the outlet of the progressive cavity pump perpendicular to the longitudinal axis according to FIG. 2*b;*
Figures 3A, 3B, 3C:
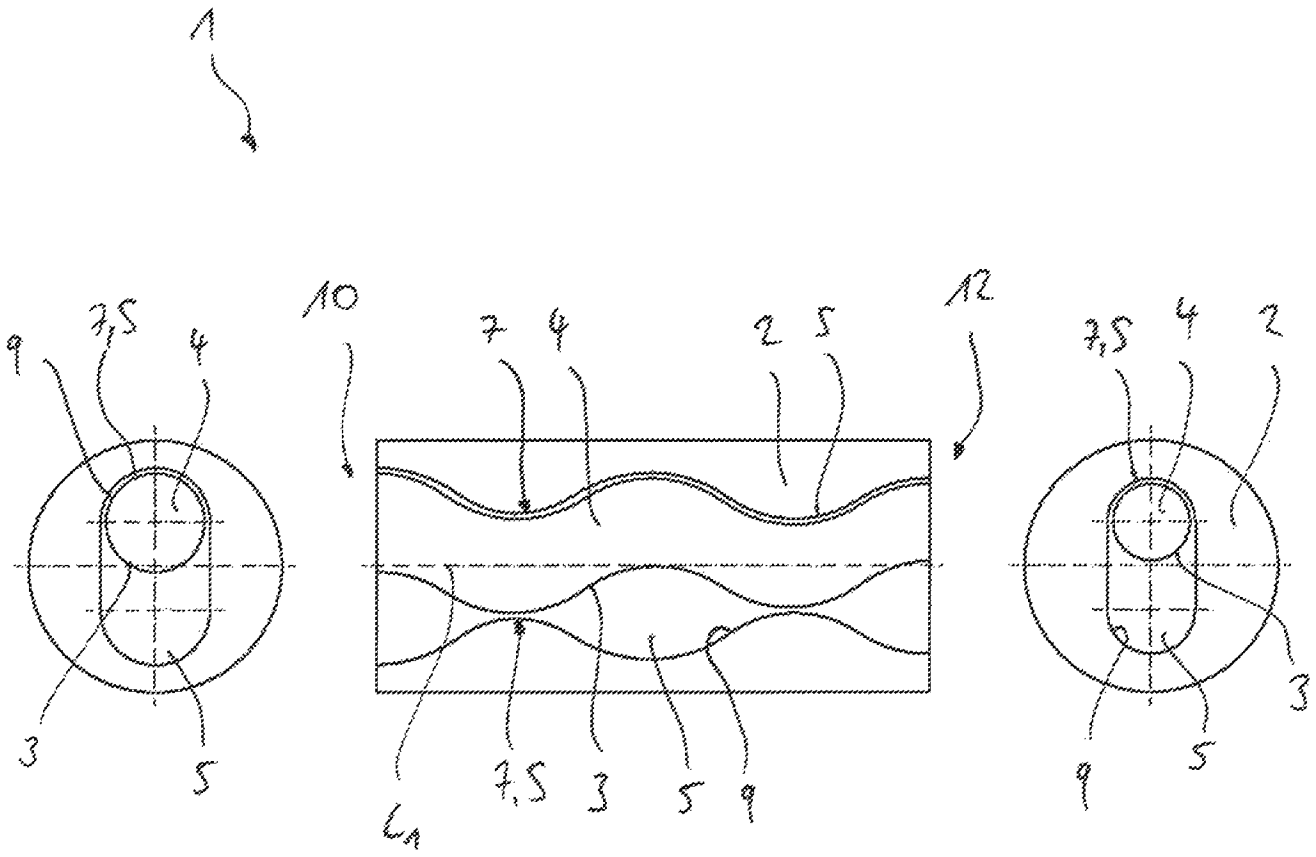
FIG. 3*a* is a schematic cross section of the inlet of and through a progressive cavity pump perpendicular to the longitudinal axis with a leakage gap set.
FIG. 3*b* is a schematic cross section along the longitudinal axis of the progressive cavity pump according to FIG. 3*a;*
FIG. 3*c* is a schematic cross section of the outlet of the progressive cavity pump perpendicular to the longitudinal axis according to FIG. 3*b;*

FIGS. 2*a*, 2*b*, and 2*c*, as well as FIGS. 3*a*, 3*b*, and 3*c*, illustrate the change in gap geometry, that is, the expanding of the constriction 7 using a schematic depiction.

While FIGS. 2*a*-2*c* show a gap geometry having a sealing gap, wherein there is contact between the rotor 4 and the stator 2, FIGS. 3*a*-3*c* illustrate expanding of the constriction 7 so that a leakage gap S is set. FIG. 2*b* shows a section along the longitudinal axis L1, as also shown in FIG. 1. The rotor 4 is at a maximum upper position relative to FIGS. 2*a*-2*c*, as can be seen particularly in FIGS. 2*a* and 2*c*, each showing sections perpendicular to the longitudinal axis L1. FIG. 2*a* shows a section near the inlet 10 and FIG. 2*c*. shows a section at the outlet 12. As can be seen particularly in FIGS. 2*a* and 2*c*, a segment of the circumferential surface 3 of the rotor 4 contacts the inner contour 9 of the inner wall 8 of the stator 2. A sealing line D is formed in the constriction 7 by the contact. It is typically provided that the rotor 4 is positioned axially in the stator 2 such that deformation occurs in the radial direction. The stator 2 is made of a flexible material, such as particularly an elastomer. Pretension in the radial direction thus results in elastic deformation of the stator 2 in the region of the sealing line D. The friction is thereby relatively high. High friction also leads to high wear. During operation, it can occur that said radial pretension increases further, for example due to swelling of the material of the stator 2 or due to expansion of the materials due to heat input.

For shear-sensitive media, for example, it is also preferable to form a sealing line D and simultaneously also achieve relatively high radial pretension, so that medium is clearly separately at the sealing lines D between the chambers and little shearing occurs.

By axially adjusting the rotor 4 having an overall conical shape, it is possible to expand the constriction 7 and thus reduce a radial pretension or even set a leakage gap S instead of a sealing line D. It should be understood that a leakage gap S also seals off and the rotor 4 floats on a liquid film in the constriction 7 in this state. Expanding the constriction is achieved in that the rotor 4 is displaced in the direction of the conical expansion, that is, to the left with respect to FIGS. 2*a*-3*c*. The constriction 7 is thereby further expanded and a leakage gap S can form.

In the inverse case, it is also possible to make the constriction 7 smaller, that is, to contract said construction further, for example in order to eliminate a leakage gap S and to set a sealing line. This can be advantageous at high pressures, for example. High pressure can cause the stator 2 to expand radially and automatically set a leakage gap S. In order to still retain the optimal gap geometry, in such a case an axial displacement in the direction of the conical constriction, that is, to the right with respect to FIGS. 2*a*-3*c*.

The eccentricity e1, e2 in the present embodiment example (FIGS. 2*a*-3*c*) is constant, while the diameter D1, D2 of the rotor 4 becomes smaller in the direction of the outlet 12. That is, e1 and e2 are identical, while D1 is greater than D2. Embodiments are also comprised in which the diameter is constant, that is, D1 is identical to D2, and the eccentricity changes, that is, e1 is greater than e2. The effect when axially displacing varies accordingly.

Figure 4:
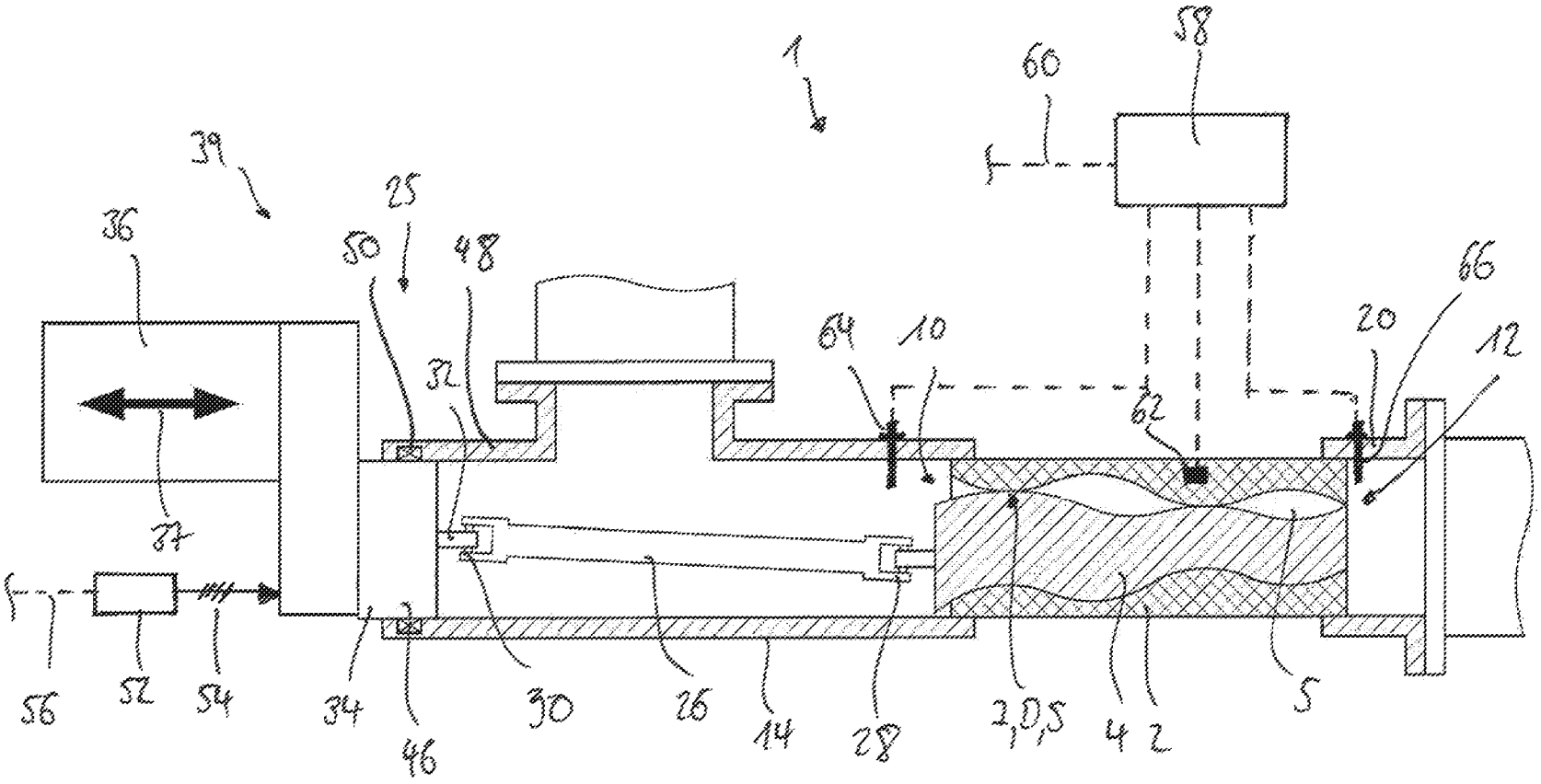
FIG. 4 is a schematic cross section through a progressive cavity pump according to a second embodiment example.

FIG. 4 shows a modified embodiment example with respect to FIG. 1, wherein similar elements are labeled with the same reference numeral. In this respect, reference is made in full to the above description of the first embodiment example (FIG. 1). With respect to the geometry of the gap in the constriction 7, reference is made to FIGS. 2*a* through 3*c*.

In contrast to the first embodiment example, in the present embodiment example (FIG. 4) the adjusting device 39 is implemented so that the rotor 4 is axially displaceable, including the entire drivetrain 25, comprising the drive shaft 26, the gearbox 34, and the drive motor 36 in the present embodiment example. In this respect, the arrow 37 indicates that the drive motor 36 is also displaced. To this end, the housing 46 of the gearbox 34 is displaceably supported in a segment 48 of the inlet housing 14 opposite the inlet 10 of the stator 2, and is sealed off from the surrounding area by a seal 50.

A separate drive 52 is provided to this end for displacing the rotor 4 in the axial direction and can displace the drivetrain 25 by means of a spindle drive 54 (shown schematically only) so that the constriction 7 between the rotor 4 and the stator 2 is expanded. When necessary, the constriction 7 can be expanded far enough that a leakage gap S results in the region of the sealing line D between the rotor 4 and the stator 2. A pretension between the rotor 4 and stator 2 is typically not entirely relieved thereby, as the transported liquid exerts a counterpressure.

The drive 52 is preferably connected to a controller to this end by means of a signal line 56. The controller is preferably integrated in or connected to a controller 58, for example by means of the signal line 60. The controller preferably has an input interface, by means of which control or regulating data is input and is implemented for performing the controlling or regulating depending on said control or regulating data. For example, a specified volume or a difference between a specified volume and an actual volume can be input into the controller by means of said interface. The interface can thereby be a user interface or an interface for connecting a sensor or switch. The controller 58 serves to determine whether and to what degree the gap geometry should be changed, that is, the constriction 7 between the rotor 4 and stator 2 should be expanded. In the present embodiment example, the controller 58 is first connected to this end to a sensor 62 disposed in the stator 2. The sensor 62 is implemented as a temperature sensor and serves for capturing the temperature of the stator 2. It should be understood that the sensor 62 can also be disposed so as to capture the temperature of the rotor 4. To this end, the sensor 62 can either detect the outer surface of the rotor 4, or said sensor or an additional sensor can be disposed in the rotor 4. The controller 58 then determines, based on the temperature measured by the sensor 62, whether a threshold temperature has been reached and, based thereon, whether and to what degree the gap geometry should be modified. Said result is sent to the drive 52 in the form of an adjusting signal via the lines 60 and 56, so that the drivetrain 25 is displaced in order to expand the constriction 7 between the rotor 4 and stator 2.

In the present embodiment example (FIG. 4), the progressive cavity pump 1 further comprises a fill level sensor 64 for determining the fill level of liquid at the inlet 10 of the stator 2. Said sensor 64 is also connected to the controller 58. The controller 58 determines a displacement of the rotor 4 relative to the stator 2 on the basis of the received fill level and sends a corresponding signal to the drive 52 for adjusting the drivetrain 25.

The progressive cavity pump 1 according to the present embodiment example (FIG. 4) further comprises a flow rate sensor 66 measuring a flow rate of liquid through the stator 2. Said sensor 66 is also connected to the controller 58, and the controller 58 determines the flow rate or flow volume per revolution on the basis of the signal from the sensor 66 and the speed of the rotor 4. If said flow rate is low, this indicates that a relatively large amount of gas is being transported, whereby the friction between the rotor 4 and the stator 2 is increased and the cooling is simultaneously reduced. This typically leads to increased material expansion and in turn to increased pretension between the rotor 4 and stator 2 and consequently to increased wear. Adjusting the gap geometry is then preferable. A pressure sensor can also be provided in place of the flow rate sensor 66, allowing pressure regulating by means of adjusting the constriction between the rotor and stator. By means of such a pressure sensor, the maintaining of a minimum pressure or a maximum pressure can also be regulated or controlled by means of adjusting the constriction. It should be fundamentally understood that such a pressure sensor can also be provided in addition to the flow rate sensor 66. The pressure sensor can also be disposed in the region of the stator or on the inlet side.

It should be understood that embodiments are also preferred in which only one of the three sensors 62, 64, 66 is present. It should be further understood that the controller 58 can also be integrated in the controller of the drive 52 and/or in the controller of the drive motor 36.

Figure 5:
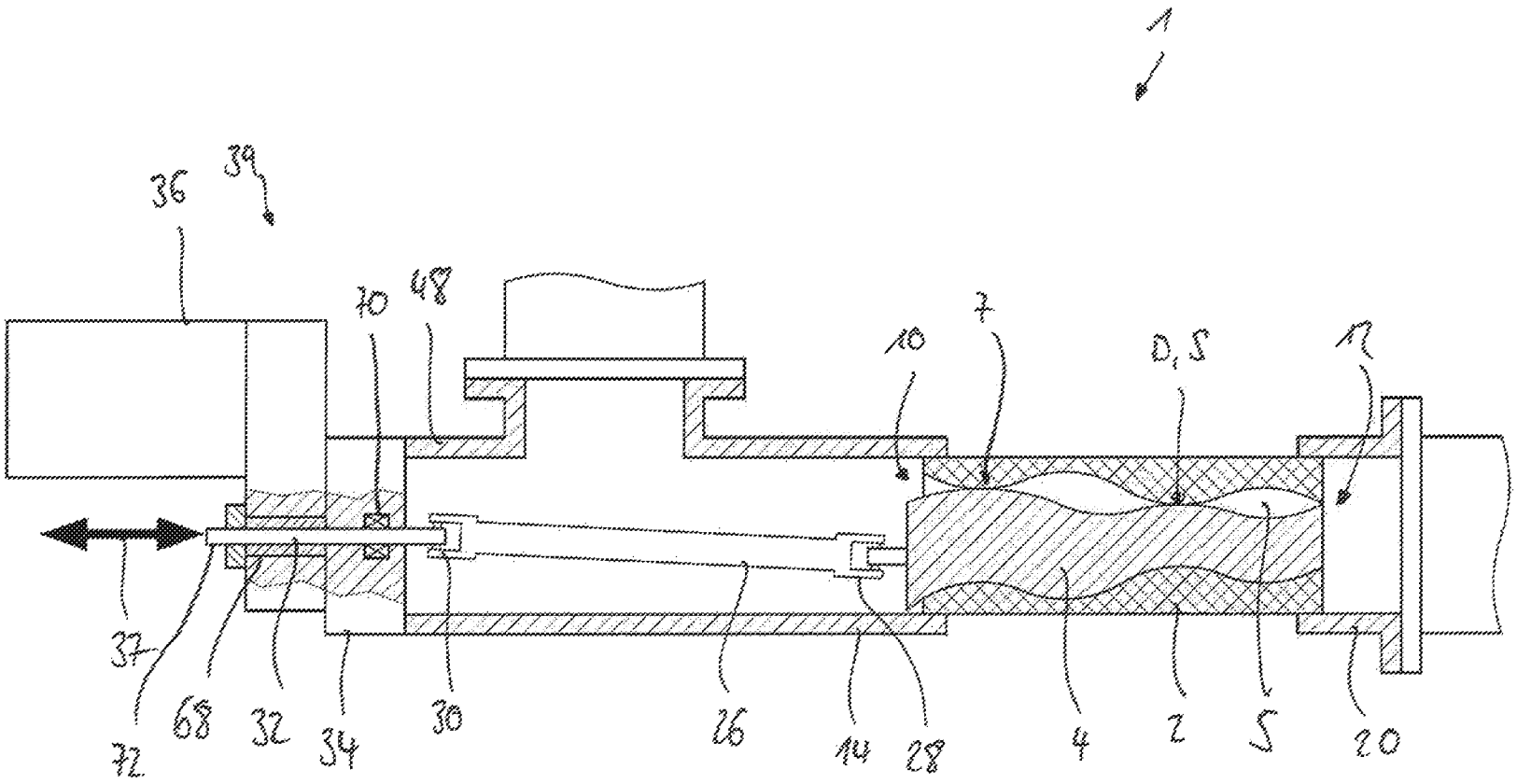
FIG. 5 is a schematic cross section through a progressive cavity pump according to a third embodiment example.

FIG. 5 shows a further embodiment example, fundamentally similar to the embodiment example of FIG. 4. Identical and similar elements are labeled with identical reference numerals, so that full reference is made to the description above. It should be understood that the sensors 62, 64, 66, described with respect to FIG. 4, can also be used in the embodiment examples of FIGS. 1, 5, 6, and 7, separately or in combination.

According to the present embodiment example (FIG. 5), the rotor 4 in turn is disposed displaceably to the stationary stator 2. In the present embodiment example, however, the drive motor 36 is also stationary and not displaceable. Overall, the drive shaft 26, in turn, is connected to the drive shaft 32 of the drive motor 36 by means of a Cardan joint 30. In order to allow displacing the rotor 4 and drive shaft 26, the drive shaft 32 is axially displaceably supported in the output gear 68 of the gearbox 34. The gear 68 is coupled to the output shaft 32 by means of an axially displaceably shaft-hub connection. The gearbox 34 is thus equipped with a gear 68 implemented as a hollow shaft, in which the shaft 32 can be displaced. The output shaft 32 in turn is guided through a seal 70 so that no liquid can penetrate from the drive inlet housing 14 into the gearbox 34. A drive 52 (see FIG. 4) can in turn be disposed at an outer segment 72 of the output shaft 32 for axially displacing the output shaft 32 and consequently the rotor 4.

Figure 6:
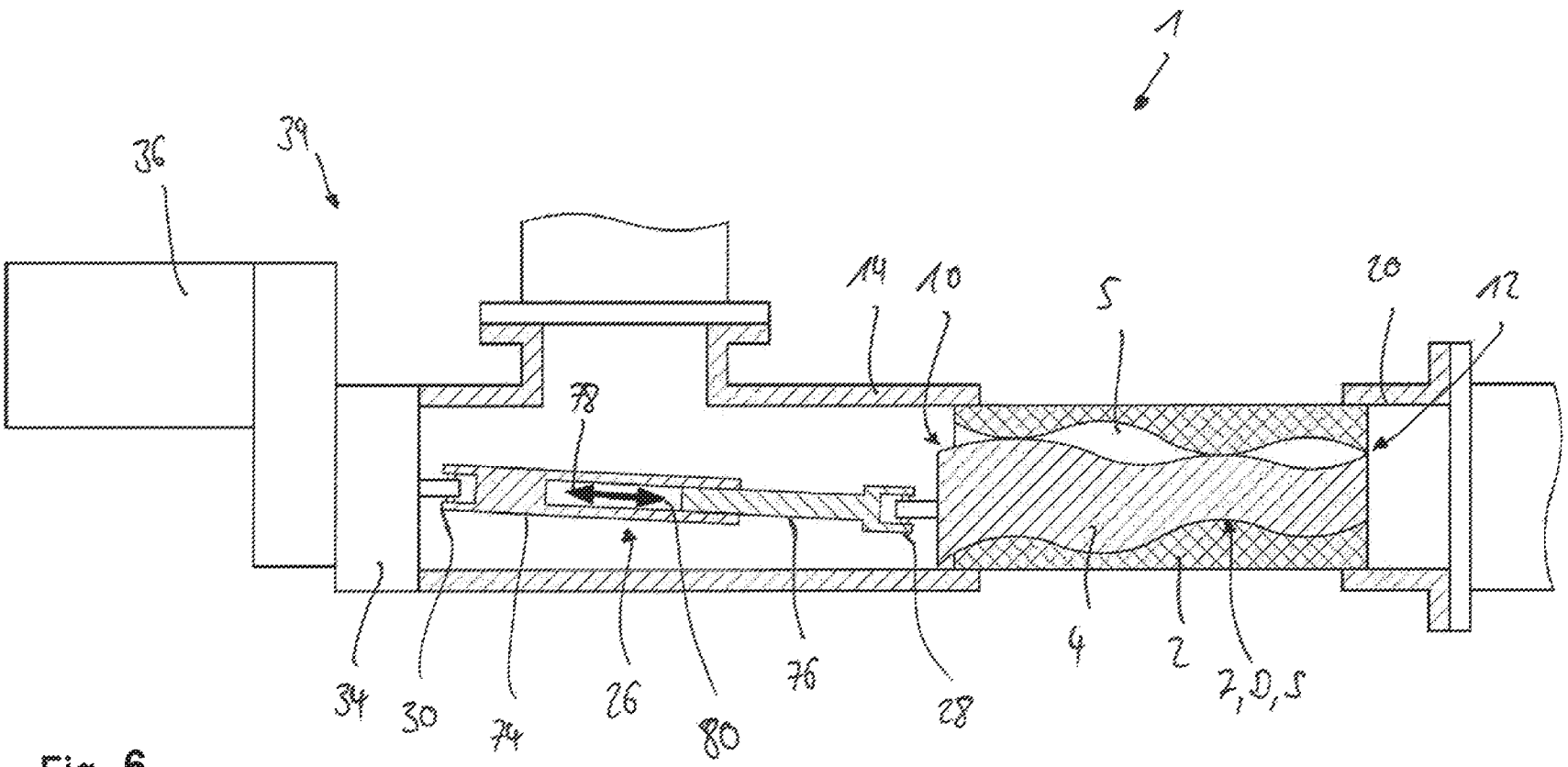
FIG. 6 is a schematic cross section through a progressive cavity pump according to a fourth embodiment example.

A further embodiment modified with respect thereto is shown in FIG. 6. Identical and similar elements are again labeled with identical reference numerals, so that full reference is made to the description above.

In the embodiment example according to FIG. 6, the rotor 4 is also displaceable, while the stator 2 is stationary and received in the inlet housing 4 and the outlet housing 20. According to the present embodiment example, the drive shaft 26 is implemented in two parts and comprises a first part 74 and a second part 76. The two parts 74, 76 are inserted in each other in a telescopic manner and an expansion member 80 is implemented in a recess 78 in the first element 74 between the two parts 74, 76. The expansion member 80 serves for allowing the axial length of the drive shaft 26 to be adjusted by displacing the second part of the shaft 76 relative to the first part of the shaft 74. By expanding the expansion member 80 or contracting the expansion member 80, displacing of the rotor 4 is made possible.

It is conceivable to implement the expansion member 80 as a passive expansion member, particularly as a hydraulic member. A hydraulic member serves for maintaining approximately constant pretension between the rotor 4 and the stator 2, so that the preload force acting on the rotor 4 is substantially constant. When the material of the stator 2 and/or of the rotor 4 expands, it is thus possible for the rotor 4 to deflect to the left with respect to FIG. 4 and is compensated for by means of the hydraulic member in the expansion member 80. Excessive wear is thereby also prevented, just as by actively adjusting the rotor 4 and/or stator 2 by means of a drive. The pressure acting in the hydraulic member can then be adapted to the pump pressure.

Figure 7:
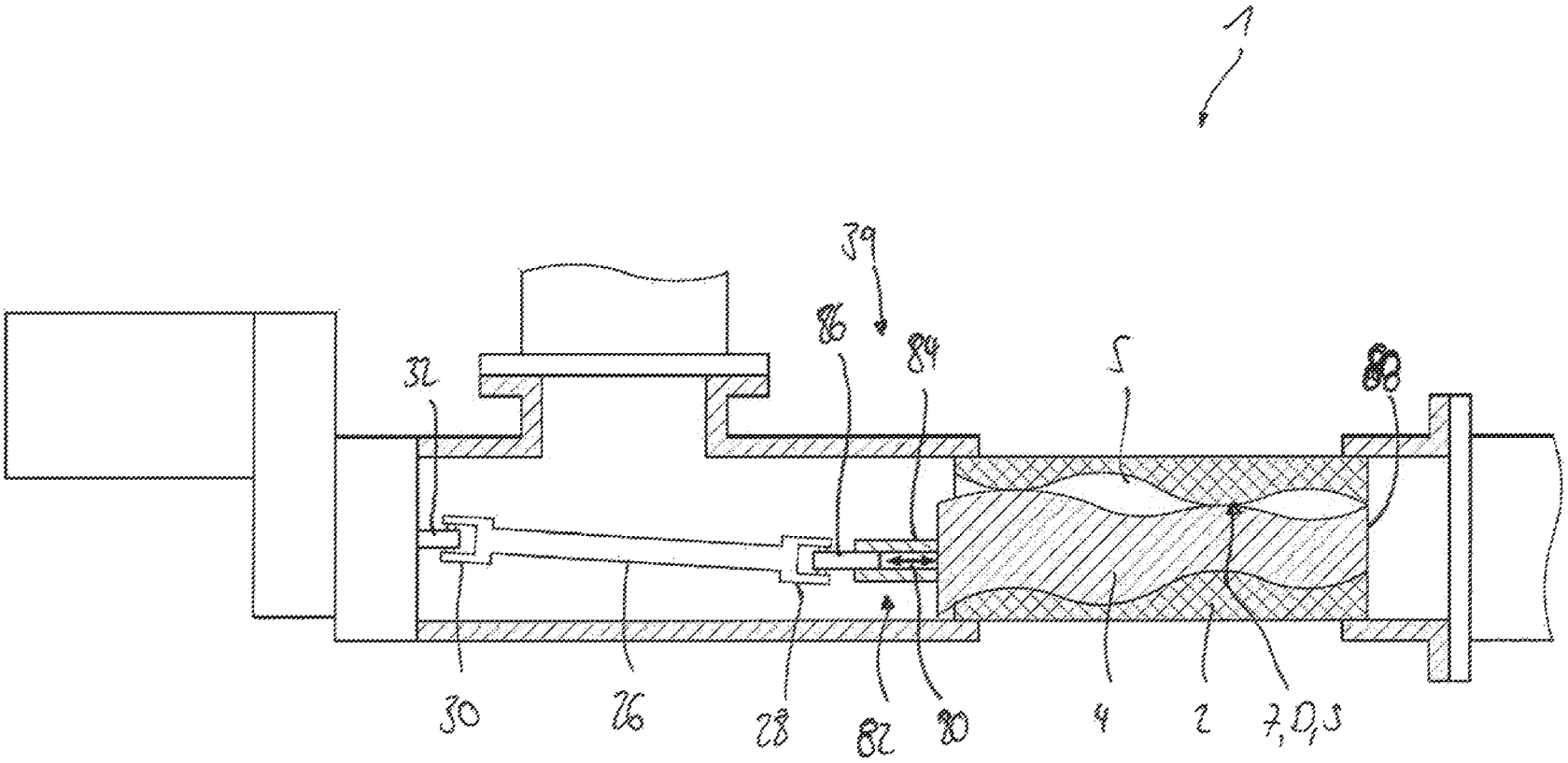
FIG. 7 is a schematic cross section through a progressive cavity pump according to a fifth embodiment example.

FIG. 7 finally shows an embodiment example of the progressive cavity pump 1 in turn allowing displacing of the rotor 4 relative to the stator 2. In the present embodiment example, the drive shaft 26 in turn is implemented as a single part, as in the first three embodiment examples of FIGS. 1, 4, and 5. The drive shaft 26 is connected to the drive shaft 32 by means of a Cardan joint 30.

In the embodiment example according to FIG. 7, the shaft stub 82 connecting the Cardan joint 28 to the rotor 4 is implemented in two parts and comprises a first part 84 rigidly connected to the rotor 4 and a second part 86 connected to the Cardan joint 28. The parts 84 and 86 are inserted into each other telescopically and an expansion member 80, corresponding to the expansion member 80 according to FIG. 4, is implemented in the part 84. Said expansion member 80 can in turn be active or passive, for example, passive in the form of a hydraulic member. Alternatively, it can also be provided that a drive acts on the end face 88 of the rotor 4 and axially displaces the rotor 4.

Figure 8:
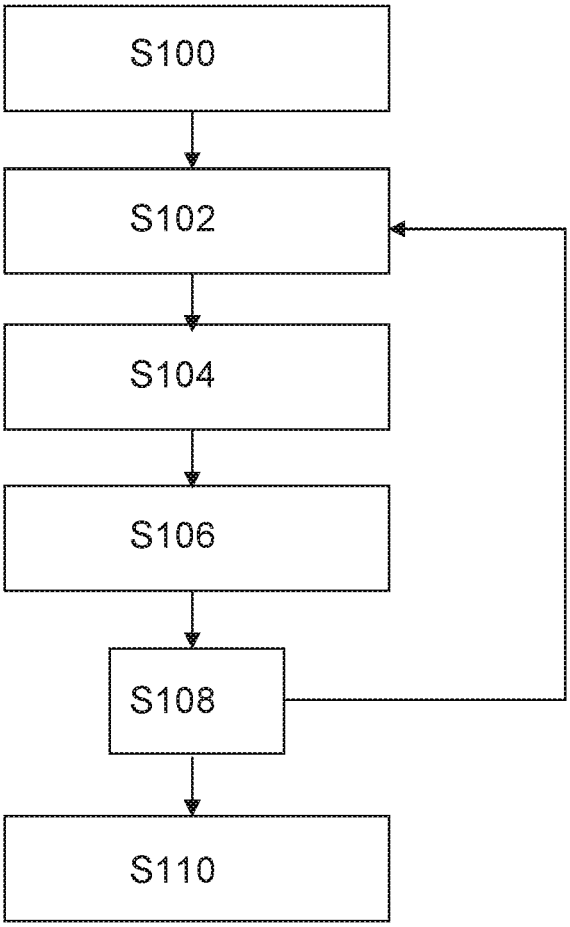
FIG. 8 is a flowchart of an embodiment example of a method for operating a progressive cavity pump.

FIG. 8 shows an example of a sequence of a method for operating a progressive cavity pump according to one of the preferred embodiments of a progressive cavity pump described above according to one of the embodiment examples 1 through 7. In step 100, the progressive cavity pump 1 is started and the rotor 4 is induced to rotate. Step 102 indicates transporting liquid from the inlet 10 to the outlet 12 of the stator 2 by rotating the rotor 4. During the present step of transporting 102, the temperature of the stator 2 is measured in step 104 by means of a temperature sensor.

Said measured temperature is compared with one or more threshold values in step 106. In step 108, it is then determined whether the threshold value, or which of the plurality of threshold values, has been exceeded, and if no threshold value has been exceeded, or the pretension, that is, the axial position of the rotor relative to the stator and thus the gap geometry, that is, the geometry of the restriction 7, matches the threshold value determined in step 106, then in step 108 the decision is made to continue to transport liquid, and to return to step 102. Otherwise, in step 110 a corresponding pretension is set. After the gap geometry has optionally been newly adjusted in step 110, the sequence can return to step 102.

It is conceivable, for example, that the temperature measured in step 104 is determined relative to a plurality of threshold values in step 106, wherein each threshold value represents an equivalent to a relative axial position of the rotor 4 and stator 2 to each other. In step 110, the corresponding axial position provided for the threshold value determined in 106 is then set. At the same time, liquid continues to be transported in step 102.

Fundamentally, at the beginning of a transport procedure, that is, prior to starting the rotational motion of the rotor relative to the stator, the constriction between the rotor and stator is expanded far enough that no or only a low transport rate takes place due to the internal leakage. The construction is then contracted according to a time-limited startup procedure of about 1.5 seconds, until a desired transport rate or a desired transport pressure is thus achieved.

The invention claimed is:

1. A progressive cavity pump for transporting a liquid containing solids comprising:

a helical rotor;

a stator within which the helical rotor is rotatably disposed about a longitudinal axis of the stator, the stator further comprising an inlet, an outlet, and a helical inner wall corresponding to the helical rotor; and wherein the helical rotor comprises a shape tapering down toward the outlet or the inlet, and the helical rotor and the stator are disposed relative to each other such that at least one chamber is formed for transporting the liquid, and the chamber is cut off by a constriction between the helical rotor and stator;

a drive shaft and a drive motor, wherein the helical rotor is coupled to the drive motor by the drive shaft, and an adjusting device for adjusting a relative axial position of the helical rotor and stator, wherein the adjusting device is adapted to adjust the constriction between the helical rotor and stator;

wherein the helical rotor is axially displaceably supported and the adjusting device is adapted to axially displace the helical rotor to at least partially adjust the constriction between the helical rotor and stator; and wherein a gearbox is disposed between the drive shaft and the drive motor, and the gearbox allows axially displacing the drive shaft, wherein the drive shaft is connected to a drive shaft of the drive motor, and wherein the gearbox is equipped with a gear implemented as a hollow shaft, in which the shaft of the drive motor is displaceable.

2. The progressive cavity pump according to claim 1, wherein the shape of the helical rotor tapering down toward the outlet or the inlet is conical.

3. The progressive cavity pump according to claim 1, wherein the shape of the helical rotor tapering down toward the outlet or the inlet is of a variable eccentricity.

4. The progressive cavity pump according to claim 1, wherein the constriction between the helical rotor and stator defines a sealing line.

5. The progressive cavity pump according to claim 1, wherein the adjusting device adjusts the constriction between the helical rotor and stator to the extent that a leakage gap is implemented between the helical rotor and stator.

6. The progressive cavity pump according to claim 5, wherein the adjusting device adjusts the constriction between the helical rotor and stator depending on one or more predetermined operating parameters.

7. The progressive cavity pump according to claim 6, wherein one of the operating parameters is the temperature of the stator and/or the helical rotor.

8. The progressive cavity pump according to claim 6, wherein one of the operating parameters is a volume of liquid transported.

9. The progressive cavity pump according to claim 6, wherein one of the operating parameters is a liquid level at the inlet of the stator.

10. The progressive cavity pump according to claim 1, wherein the stator is axially displaceably supported and the adjusting device is adapted to axially displace the stator to at least partially adjust the constriction between the helical rotor and stator.

11. The progressive cavity pump according to claim 1, wherein the longitudinal axis of the stator is oriented vertically during operation and the outlet of the stator is at the top.

12. The progressive cavity pump according to claim 1, wherein the stator is formed of a pliable material at least in the region of the helical inner wall.

13. The progressive cavity pump according to claim 12, wherein the stator is formed of an elastomer at least in the region of the helical inner wall.

14. The progressive cavity pump according to claim 1, wherein the adjusting device is adapted to expand the constriction between the helical rotor and stator prior to beginning a startup procedure or during or after a shutdown procedure of a drive motor for rotating the helical rotor, and the adjusting device is adapted to contract the constriction between the helical rotor and stator prior to beginning during the startup procedure of the drive motor.

15. The progressive cavity pump according to claim 1, wherein the adjusting device comprises an input interface for receiving a pressure signal and expands or contracts the constriction between the helical rotor and stator depending on the pressure signal.

16. The progressive cavity pump according to claim 1, wherein the adjusting device comprises an input interface for receiving a volume signal and expands the constriction between the helical rotor and stator depending on the volume signal, such that for a value of the volume signal signaling that a volume transported since the beginning of a transport procedure corresponds to a specified volume the constriction between the helical rotor and stator is expanded such that no further transporting of a volume out of the outlet of the stator occurs.

17. The progressive cavity pump according to claim 1, wherein the adjusting device adjusts the axial position of the helical rotor relative to the stator while the helical rotor rotates relative to the stator.

18. A method for operating a progressive cavity pump comprising a helical rotor, a stator within which the helical rotor is rotatably disposed about a longitudinal axis of the stator, the stator further comprising an inlet, an outlet, and a helical inner wall corresponding to the helical rotor, wherein the helical rotor comprises a shape tapering down toward the outlet or the inlet, and the helical rotor and the stator are disposed relative to each other such that at least one chamber is formed for transporting the liquid, and the chamber is cut off by a constriction between the helical rotor and stator, a drive shaft and a drive motor, wherein the helical rotor is coupled to the drive motor by the drive shaft, and an adjusting device for adjusting a relative axial position of the helical rotor and stator, wherein the adjusting device is adapted to adjust the constriction between the helical rotor and stator, wherein the helical rotor is axially displaceably supported and the adjusting device is adapted to axially displace the helical rotor to at least partially adjust the constriction between the helical rotor and stator, and wherein a gearbox is disposed between the drive shaft, and the drive motor and the gearbox allows axially displacing the drive shaft, wherein the drive shaft is connected to a drive shaft of the drive motor, and wherein the gearbox is equipped with a gear implemented as a hollow shaft, in which the shaft of the drive motor is displaceable;

wherein the method comprises the steps of:

driving the helical rotor via the drive motor for transporting a liquid; and adjusting the constriction between the helical rotor and stator by axially displacing the helical rotor and stator relative to each other.

19. The method according to claim 18, wherein the step of adjusting the constriction between the helical rotor and stator further comprises the step of:

adjusting a leakage gap between the helical rotor and stator.

20. The method according to claim 18, further comprising the steps of:

measuring a temperature of the helical rotor or of the stator via a temperature sensor;

axially relatively displacing the helical rotor and stator depending on the measured temperature.

21. The method according to claim 18, further comprising the steps of:

determining a liquid level at the inlet of the stator via a liquid sensor;

axially relatively displacing the helical rotor and stator depending on the liquid level determined.

22. The method according to claim 18, further comprising the steps of:

determining a liquid volume transported per revolution of the helical rotor via a liquid sensor; and axially relatively displacing the helical rotor and stator depending on the liquid volume determined.

23. The method according to claim 18, wherein the constriction between the helical rotor and stator is expanded at the start of a startup of a drive motor for rotating the helical rotor, and the constriction between the helical rotor and stator is contracted after starting the startup procedure of the drive motor.

24. The method according to claim 18, wherein a pressure is measured by a pressure sensor, and the constriction between the helical rotor and stator is expanded or contracted depending on the pressure.

25. The method according to claim 18, wherein a specified volume is measured via a liquid sensor and the constriction between the helical rotor and stator is expanded or contracted depending on the specified volume.

26. The method according to claim 18, wherein the helical rotor is adjusted relative to the stator in the axial direction along the axis of rotation, while the helical rotor is driven about the axis of rotation in a rotary motion for transporting the liquid relative to the stator.

* * * * *